US010327605B2

(12) United States Patent
Zagar et al.

(10) Patent No.: US 10,327,605 B2
(45) Date of Patent: Jun. 25, 2019

(54) AIR BAR CLEANING TOOL, SYSTEM AND METHOD

(71) Applicant: Babcock & Wilcox MegTec, LLC, De Pere, WI (US)

(72) Inventors: Steven Zagar, Luxemburg, WI (US); Andreas Keil, Munich (DE)

(73) Assignee: Durr MEGTEC, LLC, DePere, WI (US)

( * ) Notice: Subject to any disclaimer, the term of this patent is extended or adjusted under 35 U.S.C. 154(b) by 251 days.

(21) Appl. No.: 14/967,728

(22) Filed: Dec. 14, 2015

(65) Prior Publication Data

US 2016/0174784 A1 Jun. 23, 2016

Related U.S. Application Data

(60) Provisional application No. 62/093,815, filed on Dec. 18, 2014.

(51) Int. Cl.
*A47L 5/14* (2006.01)
*B08B 1/00* (2006.01)
(Continued)

(52) U.S. Cl.
CPC ..... *A47L 5/14* (2013.01); *B05B 15/522* (2018.02); *B05B 15/555* (2018.02); *B08B 1/008* (2013.01);
(Continued)

(58) Field of Classification Search
None
See application file for complete search history.

(56) References Cited

U.S. PATENT DOCUMENTS 5,105,562 A 4/1992 Hella et al.
2003/0155373 A1* 8/2003 Kweon ..... B05B 15/0208 222/148
(Continued)

FOREIGN PATENT DOCUMENTS

DE 19605195 A1 8/1997
DE 19814491 A1 10/1999
(Continued)

OTHER PUBLICATIONS

English Machine Translation of KR100795548 (Year: 2008).*
(Continued)

*Primary Examiner* — Mikhail Kornakov
*Assistant Examiner* — Pradhuman Parihar
(74) *Attorney, Agent, or Firm* — Nields, Lemack & Frame, LLC

(57) ABSTRACT

Cleaning air knife elements are assembled in a parallel orientation inside a housing enclosing the air knife assembly and in fluid communication with a compressed air source. In certain embodiments, the air knife elements are spaced apart a distance that orients the cleaning air knife discharge slots directly parallel and in line with the slots of the air nozzle or bar to be cleaned. Air discharging from the air knife discharge slots passes through the discharge slots of the air nozzle to be cleaned, dislodging dust and friable solid buildup from the air nozzle slots. Additionally, the cleaning air jet enters the air nozzle body, further dislodging dust and friable solids from the internal passages of the air nozzle inside the air nozzle body.

14 Claims, 6 Drawing Sheets

(51) Int. Cl.

| | |
|---|---|
| ***B08B 5/02*** | (2006.01) |
| ***B08B 9/043*** | (2006.01) |
| ***B05B 15/522*** | (2018.01) |
| ***B05B 15/555*** | (2018.01) |
| ***B08B 9/00*** | (2006.01) |

(52) U.S. Cl.
CPC ..... *B08B 5/02* (2013.01); *B08B 9/043* (2013.01); *B08B 9/00* (2013.01)

(56) References Cited

U.S. PATENT DOCUMENTS

| | | | | |
|---|---|---|---|---|
| 2004/0213913 | A1 | 10/2004 | Jung et al. | |
| 2006/0054186 | A1* | 3/2006 | Lepage | B08B 1/008 134/6 |
| 2014/0053883 | A1* | 2/2014 | Wang | B05B 15/0225 134/167 R |

FOREIGN PATENT DOCUMENTS

| | | | |
|---|---|---|---|
| DE | 10312047 | A1 | 6/2004 |
| DE | 102009022269 | A1 | 11/2010 |
| KR | 100795548 | B1 * | 1/2008 |
| WO | 2010/141587 | A1 | 12/2010 |

OTHER PUBLICATIONS

European communication dated May 6, 2016 in corresponding European patent application No. 15201392.6.
European communication dated Nov. 26, 2018 in corresponding European patent application No. 15201392.6.

* cited by examiner

AIR BAR CLEANING TOOL, SYSTEM AND METHOD

This application claims priority of U.S. Provisional Application Ser. No. 62/093,815 filed Dec. 18, 2014 and titled "Air Bar Cleaning Tool and Method", the disclosure of which is hereby incorporated by reference as if it was fully set forth herein in its entirety.

FIELD

Embodiments disclosed herein relate to an air bar or nozzle cleaning tool, and a system for and method of cleaning an air bar or nozzle using the same.

BACKGROUND

Air bars or nozzles are used to direct a jet of air to impinge on the surface of a material to carry out heat and/or mass transfer functions. As is known to those skilled in the art, a plurality of air nozzles may be arranged in an array or multiple arrays to direct air impingement over a large surface of a material in web form, either on one side of the web, or both sides simultaneously. Flotation air bars are a type of air nozzle used in industrial dryers and ovens to floatingly support and convey a continuous web to be processed by thermal treatment, which may include any combination of drying, heating, curing or cooling of the web. In many cases a coating is applied to the surface of the web or a volatile material is present within the base web material which must be dried and/or heated to a particular temperature so as to facilitate thermal curing of a polymer material in the coating. Web materials commonly processed in this manner include paper, plastic film, metal foils, woven and non-woven fabrics and mats, and porous membrane materials. In many processes the volatilized materials within the web or coating after being liberated from the web surface are carried away from that surface by the spent nozzle air and conducted by an air handling system to an exhaust path, or recirculated to the air nozzles via an air handling system. Within the air handling system, the recycled air is typically re-heated by a burner or other suitable air heating means and pressurized by a fan in order to supply the heated air to the air nozzles under sufficient pressure to deliver the supply air jets at the desired impingement velocity. In some cases the materials in the recycled air either condense or are chemically altered and produce solid, semi-solid or viscous liquid forms of the liberated material. Due to the recirculation of the air within the dryer air handling system, these solid, semi-solid or viscous liquid materials can accumulate as deposits on or inside the nozzles. When deposits block the flow of air reaching or passing through the apertures of the air nozzle, the heat transfer capability of the blocked nozzles is diminished, often resulting in reduced production capacity and economic loss. Cleaning of the nozzles typically requires shut down of the process and cooling of the oven apparatus to facilitate access for manual cleaning. Clearing of the material blocking the nozzle flow usually requires some combination of brushing, scraping, loosening with compressed air blast, and vacuuming.

Although it is desirous to clean air nozzles in situ, most nozzles are designed so as to be removable from the oven enclosure to facilitate access for thorough cleaning. Removal for cleaning and remounting of the air bars is known to be an arduous and time-consuming task which increases costs of maintenance and further negatively impacts the productivity of the production line. Various tools and devices intended to clean air nozzles in-situ such as scraper knives or brushes fastened to extension poles have been fashioned by maintenance personnel with limited cleaning effectiveness. In some cases, such devices have been known to damage the integrity of the nozzles by deforming the nozzle apertures, resulting in adverse effects in product quality such as drying defects, marking, or web breaks.

A particular family of processes wherein curable silicone coatings are applied to a web, such as in the production of release liners for pressure sensitive adhesive tapes, films and sheets, suffers from extensive generation of dust buildup within the nozzles and air handling systems of the drying and curing ovens used for this purpose. Many of these silicone release liner products are dried and cured in flotation ovens. In this type of oven, not only is heat transfer and drying capacity diminished when deposits block nozzle apertures, the conveyance function of the flotation dryer is also compromised, leading to web product defects. Known apparatus and methods used to attempt cleaning of flotation nozzles in situ are only minimally effective. Deposits inside of the air bar apertures and flow distribution elements within the body of the air bar cannot be reached effectively by most mechanical means when accessing the air bars in situ. Further, cleaning of the flotation air bars by improper mechanical methods can result in degradation and even permanent damage to the apertures adversely affecting the stable flotation conveyance of the web as well as adverse heat transfer and drying effects.

In most cases, thorough cleaning of air bars can be practically accomplished only by removal from the oven and careful washing and/or vacuuming steps requiring a significant amount of downtime.

It is therefore an aspect of embodiments disclosed herein to provide an apparatus (tool) which can effectively remove buildup within the flotation air nozzle while in situ. It is a further aspect of embodiments disclosed herein to ensure that the mechanical interaction of the cleaning tool with the air bars is not detrimental to the mechanical integrity of the nozzle apertures. Further, in certain embodiments, the sequence of cleaning steps provides for removal of dust/material from the nozzles so as to prevent re-accumulation of dust from deposits already freed from the internal surfaces of the air bars, thus extending the time between cleanings.

SUMMARY

In accordance with certain embodiments, cleaning air knife elements (two shown), such as those available from ExAir Corporation, Cincinnati, Ohio, are assembled in a parallel orientation inside a housing enclosing the air knife assembly and in fluid communication with a compressed air source. In certain embodiments, the air knife elements are spaced apart a distance that orients the cleaning air knife discharge slots directly parallel and in line with the slots of the air nozzle or bar to be cleaned. Air discharging from said air knife discharge slots passes through the discharge slots of the air bar to be cleaned, dislodging dust and friable solid buildup from the air bar slots. Additionally, the cleaning air jet enters the air bar body, further dislodging dust and friable solids from the internal passages of the air bar inside said air bar body.

One embodiment includes an air bar cleaning tool comprising a housing, one or more air knife elements in the housing, each air knife element having a discharge slot and a tab extending from the discharge slot, wherein the discharge slot and tab are adapted to be aligned with a slot in the air bar to be cleaned. A propelling assembly for propelling the tool along the length of the air bar being cleaned may be used, and may include a spring-loaded yoke for supporting the housing.

Another embodiment includes a system for cleaning an air nozzle or bar, comprising an air bar to be cleaned, the air bar having an air bar slot; a housing sealed to the air bar; an air knife element in the housing, the air knife element having a discharge slot and a tab extending from the discharge slot, wherein the discharge slot and tab are aligned with the air bar slot such that the tab is received in the air bar slot; and a source of compressed air in fluid communication with the air knife element. In certain embodiments, the housing includes two air knife elements, each having a discharge slot and a tab extending therefrom.

Yet another embodiment includes a method of cleaning an air nozzle or bar having at least one air bar discharge slot, comprising providing an air bar cleaning tool comprising a housing, at least one air knife element in the housing, each air knife element having a discharge slot and a tab extending from the discharge slot; aligning the housing with the air bar such that the air knife element discharge slot aligns with the air bar discharge slot and the tab enters the air bar discharge slot; introducing air through the air knife discharge slot and into the air bar discharge slot; and moving the housing along the length of the air bar.

In certain embodiments, the housing is moved along the length of the air nozzle with an actuator. In certain embodiments, the actuator is responsive to a controller.

These and other non-limiting aspects of the disclosure are more particularly described below. For a better understanding of the embodiments disclosed herein, reference is made the accompanying drawings and description forming a part of this disclosure.

BRIEF DESCRIPTION OF THE DRAWINGS

The embodiments disclosed herein may take form in various components and arrangements of components, and in various process operations and arrangements of process operations. The drawings are only for purposes of illustrating preferred embodiments and are not to be construed as limiting. This disclosure includes the following drawings.

DETAILED DESCRIPTION

Figure 1D:
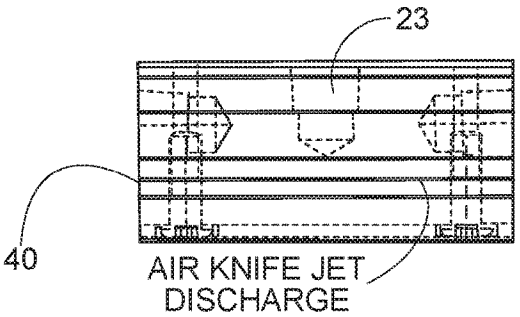
FIG. 1D is a top view of a cleaning tool in accordance with certain embodiments.
Figure 1C:
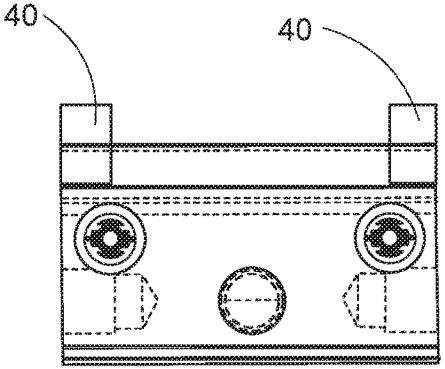
FIG. 1C is a front view of a cleaning tool in accordance with certain embodiments.
Figure 1B:
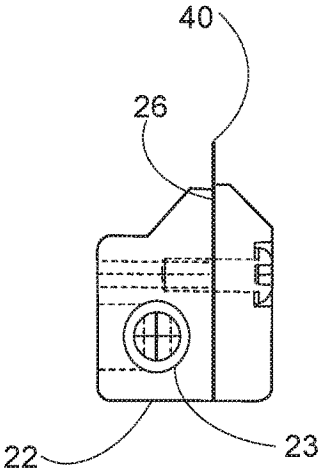
FIG. 1B is a side view of a cleaning tool in accordance with certain embodiments.
Figure 1A:
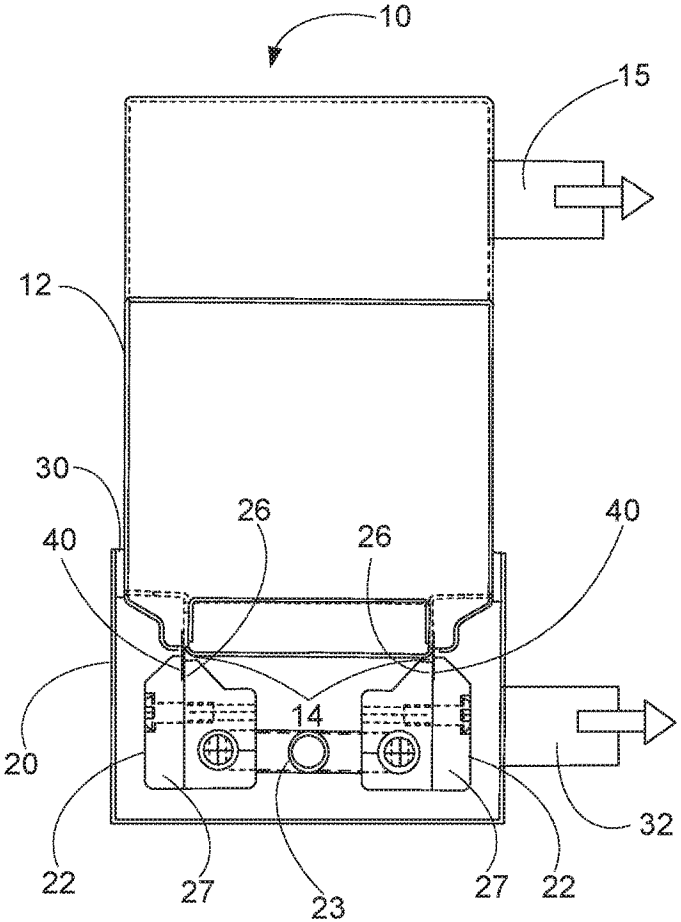
FIG. 1A is a schematic view of an air nozzle with a cleaning tool engaged therewith in accordance with certain embodiments.

A more complete understanding of the components, processes, systems, methods and apparatuses disclosed herein can be obtained by reference to the accompanying drawings. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and the include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

All ranges disclosed herein are inclusive of the recited endpoint and independently combinable (for example, the range of "from 2 inches to 10 inches" is inclusive of the endpoints, 2 inches and 10 inches, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

It should be noted that many of the terms used herein are relative terms. For example, the terms "upper" and "lower" are relative to each other in location, i.e. an upper component is located at a higher elevation than a lower component, and should not be construed as requiring a particular orientation or location of the structure. As a further example, the terms "inward", and "outward" are relative to a center, and should not be construed as requiring a particular orientation or location of the structure.

Turning now to FIGS. 1A through 1D, there is shown an air bar or nozzle 10 having an air nozzle or air bar body 12. During operation, the air nozzle or bar 10 is in fluid communication with a gas source, such as a supply of air, for heating or cooling a web, and/or for floating the web. The air nozzle 10 has one or more nozzle slots or openings 14 (two shown) for discharging gas towards the web. In some embodiments, the nozzle slots can be Coanda slots. In certain embodiments, the air nozzle 10 can include an air bar vacuum withdrawal port or connection 15.

A cleaning tool housing 20 is shown engaged with the air nozzle 10. In certain embodiments, the housing 20 houses one or more (two shown) cleaning air knife elements 22. In certain embodiments, the number of cleaning air knife elements 22 in a housing 20 corresponds to the number of slots in the air bar 10 to be cleaned. In certain embodiments, each cleaning air knife element 22 is 2 to 6 inches in length, most preferably 4 inches in length, and is assembled in a parallel orientation inside housing 20 enclosing the air knife assembly and in fluid communication with a compressed air source via a feed port 23. In certain embodiments, the compressed air source is regulated to a pressure between 40 and 80 psig.

In certain embodiments, each air knife element 22 includes a housing 27 having an air knife discharge slot 26, and the air knife elements 22 are spaced apart a distance that orients the cleaning air knife discharge slots 26 directly parallel and in line with the slots 14 of the air bar 10 to be cleaned. Air discharged from the air knife discharge slots 26 passes through the discharge slots 14 of the air nozzle 10 to be cleaned, dislodging dust and friable solid buildup from the air nozzle slots 14. Additionally, the cleaning air jet enters the air nozzle body 12, further dislodging dust and friable solids from the internal passages of the air nozzle inside the air nozzle body 12.

In certain embodiments, the housing 20 supports the air knife elements 22 and encloses the air knife elements 22 and extends an additional to 2 inches, preferably 1 inch beyond each end of the air knife elements 22 to provide passages for vacuum air flow inside each end of the cleaning tool housing 20. The housing 20 engages the air nozzle body 12 and is fitted with sliding seal elements 30 to create a seal between the housing 20 and the air nozzle body 12. In certain embodiments, the sliding seal elements 30 may be made of brush material or preferably of low-friction solid materials such as Teflon® or Nylon.

An optional hose connection 32 may be connected to a vacuum source (not shown) through a vacuum hose, such as commonly available for shop utility vacuum appliances. The vacuum flow into the vacuum appliance is drawn from inside the air nozzle body 12 and carries dust and dislodged solid material away from the internal surfaces through the internal passages of the air bar, through the air bar discharge slots 14 and through the vacuum air flow passages inside the ends of the cleaning tool housing 20 to the hose connection port 32.

Figure 3:
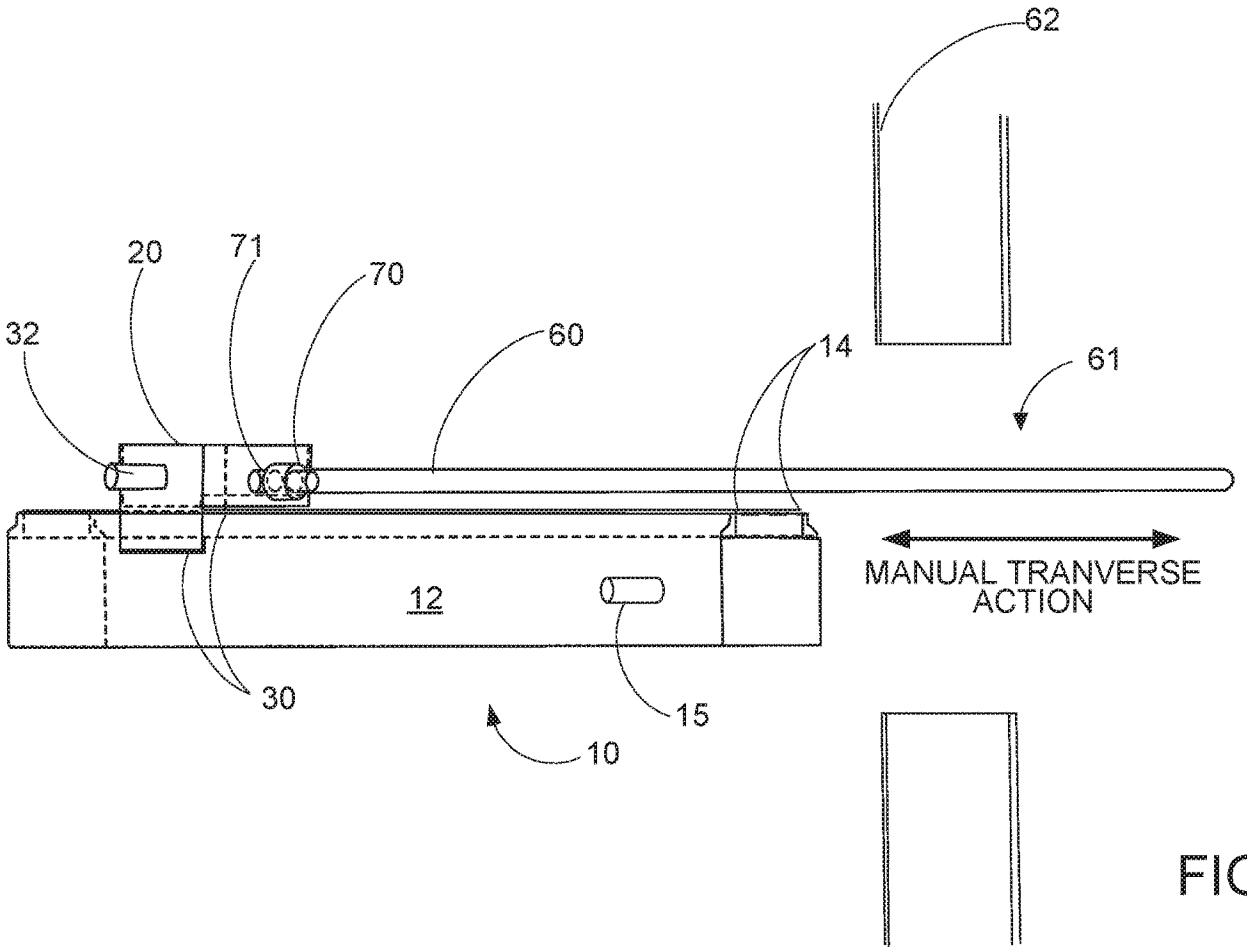
FIG. 3 is a schematic diagram of an air nozzle and cleaning tool shown traversing the air nozzle in accordance with certain embodiments.
Figure 4:
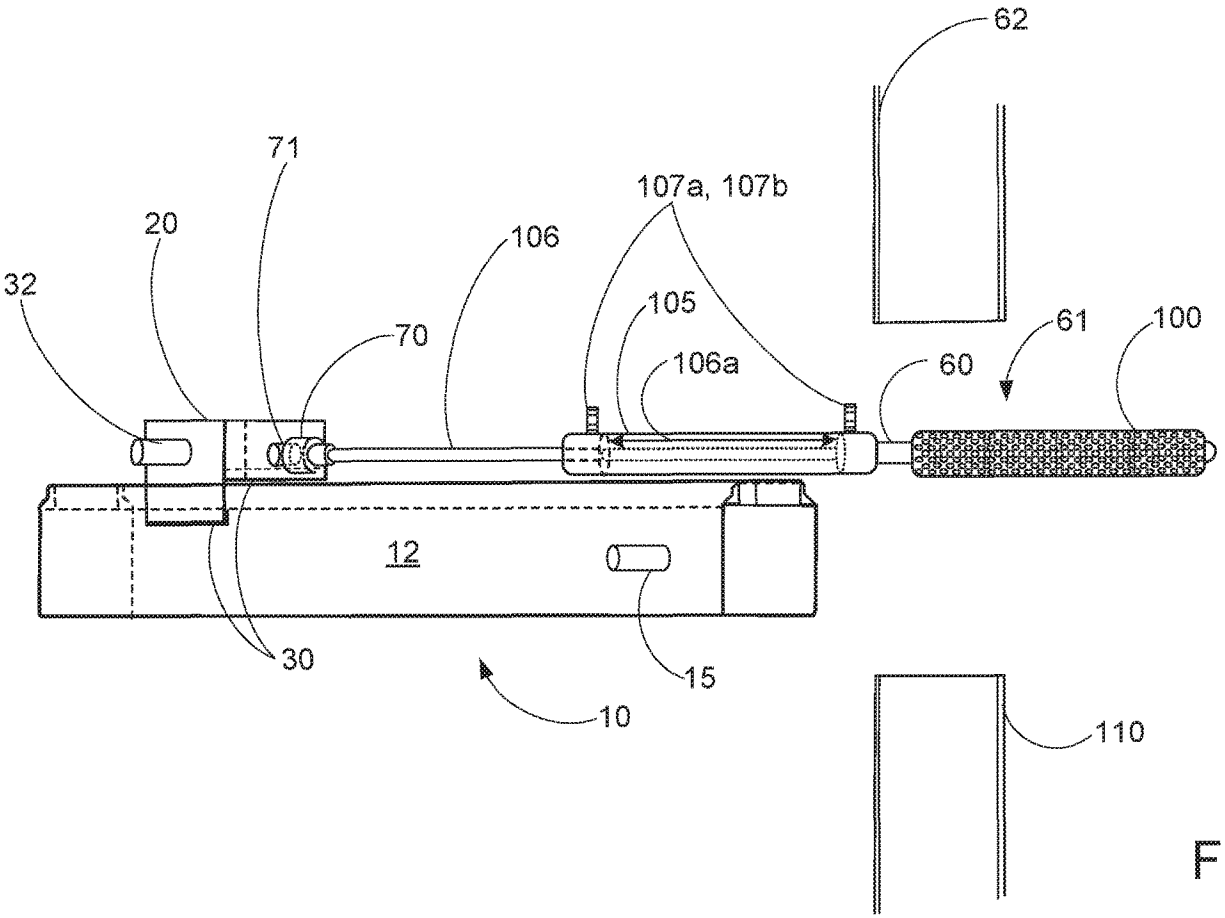
FIG. 4 is a schematic diagram of an air nozzle and cleaning tool shown traversing the air nozzle and including a linear actuator in accordance with certain embodiments.

In the embodiments shown, for example see FIGS. 3 and 4, the rod 60 extends towards an access opening 61 in the dryer housing 62, allowing for manual traverse action of the rod 60 by an operator so that the housing 20 can be moved along the length of the air bar 10 to clean the discharge slots 14 along their entire length.

The tabs 40 (see for example FIG. 1) may be made of rigid metal such as spring steel, preferably of a hardness greater than the material of the air nozzle body 12. In certain embodiments, the tabs 40 may be formed with a beveled or curved profile to prevent catching in the air bar slots 14 or gouging the edges of the air bar slots 14 as the assembly is propelled along the air bar 10 to be cleaned. The tabs 40 provide a mechanical means of cleaning solids from the air bar discharge slots 14 in conjunction with the air knife jet cleaning action. In certain embodiments, the tabs 40 extend preferably 10 mm outward from the discharge slot 26 of the air knife element 22 in the jet flow direction and are 5 to 20 mm, preferably 10 mm, in width, extending along the air knife discharge slot 26 length direction from the ends of the air knife element inward toward the center of the discharge slot length. This tab spacing (preferably 80 to 100 mm apart) and arrangement having four tabs engaged, two per air knife discharge slot engaged with each side of the slot opening, provides a stable engagement with the air bar slots 14, preventing mechanical damage from misalignment forces that would otherwise create a prying action on the air bar slot gap. Accordingly, in certain embodiments, the tabs 40 of each air knife element 22 are positioned to be received by and engage a respective discharge slot 14 of the air bar to be cleaned. Although preferably each air knife element has at least two spaced tabs 40, an air knife element 22 having a single tab 40 can be used.

The housing 20 may be supported by the sliding seal elements 30 riding on the air bar 10 top surface in the case of air bars facing upward (lower air bar nozzles in the oven).

Figure 2:
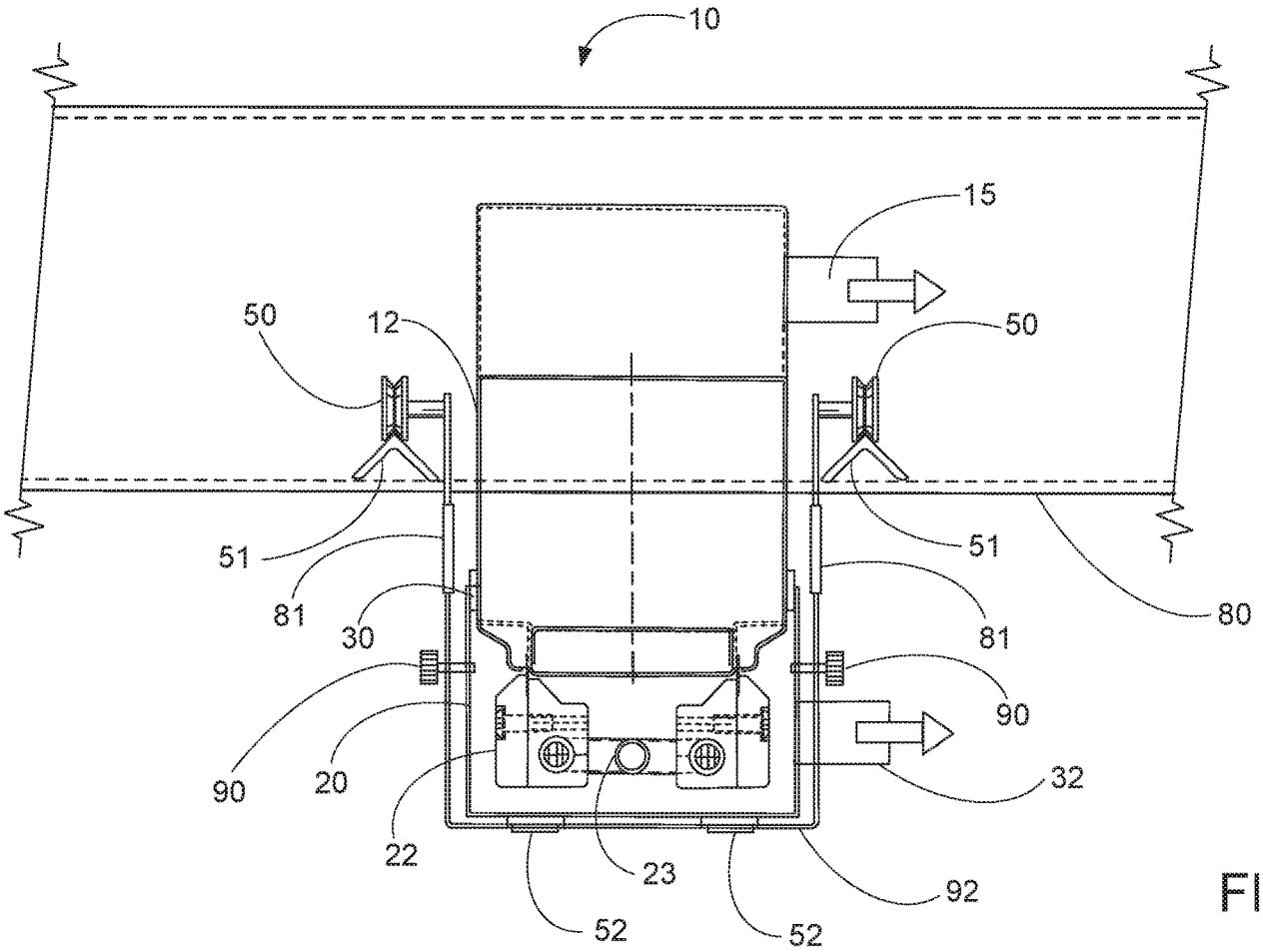
FIG. 2 is a schematic view of an air nozzle with a cleaning tool engaged therewith and supported on a yoke in accordance with certain embodiments.

In the case of cleaning the downward facing air bars (upper air bar nozzles in the oven), the housing 20 may be supported by means of a yoke assembly (FIG. 2) having spring-loaded rollers engaged and supported on moveable track bars or rails 51 attached to the upper air bar support frame. The rails 51 may be removable or permanently attached to the header 80. In some embodiments, the yoke assembly may be attached to the housing 20 with suitable latch clamps 52, such as quick spring latch clamps, and/or with engagement pins 90 as shown. Optionally, the movable rails 51 can be used to support the housing 20 for cleaning of the lower air bars by means of a spring-loaded yoke assembly, including gas springs 81 and yoke frame 92, in a similar manner as for the upper air bars.

One advantage of the embodiments disclosed herein is the cleaning action is provided by high velocity air knife jet action in combination with the mechanical scraper action of the tabs 40 along with vacuum air flow which provides an enhanced sheering action at the ends of the air knife jets in conjunction with the vacuum air flow acting in the opposite direction. For effective in situ cleaning of air bars, the operator, after following safe lock-out procedures and utilizing all necessary personal protection equipment, engages the cleaning tool housing to the air bar 10 to be cleaned, such as with the support yoke. A compressed air source is connected to the cleaner tool assembly via feed port 23; preferably by quick connect/disconnect fittings with a local hand valve to shut off flow. A vacuum source (e.g., a conventional SHOP-VAC® vacuum) appliance is connected to the cleaner tool housing connection. Vacuum is started first, followed by opening the compressed air source such as with a valve (not shown). The cleaner is manually traversed over the entire length of the air bar 10. Following full traverse, the vacuum may be optionally disengaged and attached to vacuum port 15 on the air nozzle body 12 of the air bar (if provided) and the cleaner tool again traversed with compressed air on to blow and vacuum loose material directly from inside the air bar body. The compressed air source valve is then closed and the vacuum source disconnected. The cleaner tool is disengaged from the cleaned air bar. The procedure may be repeated for each air bar to be cleaned. A suitable controller may be used to traverse the cleaner rather than manual traverse.

It is to be appreciated that in certain embodiments, the cleaning operation of air nozzles in a flotation oven requires portability of the cleaning apparatus to interact with a plurality of air nozzles inside said dryer (oven). Therefore the portability and ease of positioning the cleaning housing 20 in a repetitive fashion is desired. Portability and positioning of the housing 20 on a plurality of the air nozzles may be carried out manually by a human operator or include pneumatic or electric powered assistance.

With reference to FIG. 3, in certain embodiments, the housing 20 may be manually propelled along the length of the air nozzle body 12 with an articulating push/pull rod 60 coupled to the housing 20 by any suitable means, such as a flexible coupling 70 coupled to a housing attachment rod 71, allowing free rotation of the housing 20 such that air knife elements 22 are held in line with the discharge slots 14 of the air bar 10 via tabs 40 which are received by and penetrate into respective air bar discharge slots 14 at each end of each air knife element and may assist in aligning the tool with the bar. The movement of the housing 20 may also be controlled by a suitable controller. In an optional embodiment (FIG. 4), controlled movement of the housing 20 may be effected by mechanically connecting a linear actuator 105 to the attachment rod 71 and/or flexible coupling 70 in lieu of or in combination with rod 60. The linear actuator 105 in mechanical connection to housing may be initially positioned manually by a human operator grasping rod handle 100 connected to rod 60 and additional motion imparted to housing 20 is effected by the linear actuator 105. The range of the travel motion of housing 20 may be selected to cover a portion of the length of air nozzle body 12 or to extend along the entire length of the air nozzle body 12 by selection of stroke length 106*a* of actuator rod 106, thus providing automated cleaning over the desired location along the length of the air nozzle body 12. The linear actuator 105 is preferably of the pneumatic air cylinder type (as commercially available from suppliers such as Bimba Manufacturing Company, University Park, Ill.) and is responsive to the controller and operated by compressed air regulated with a suitable pressure regulator and connected through suitable valves, such as solenoid operated valves, to air connection ports 107*a* and 107*b* in order to control extension and retraction of actuator rod 106. Piping and air regulation arrangements for extension and retraction motion control of the rod 106 are well known to those skilled in the art.

Figure 5:
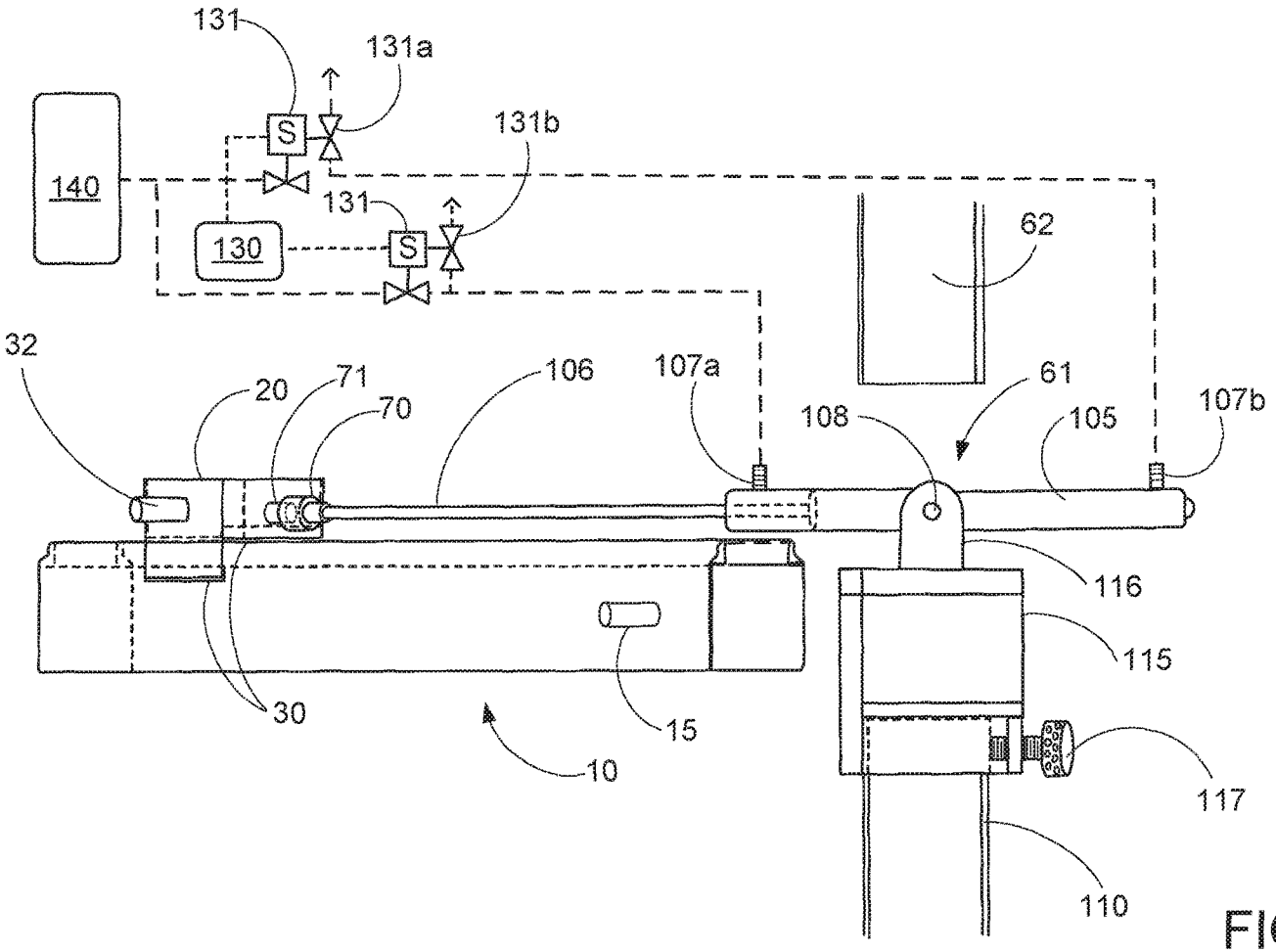
FIG. 5 is a schematic diagram of an air nozzle and cleaning tool shown traversing the air nozzle and including a linear actuator and controller assembly in accordance with certain embodiments.
Figure 6:
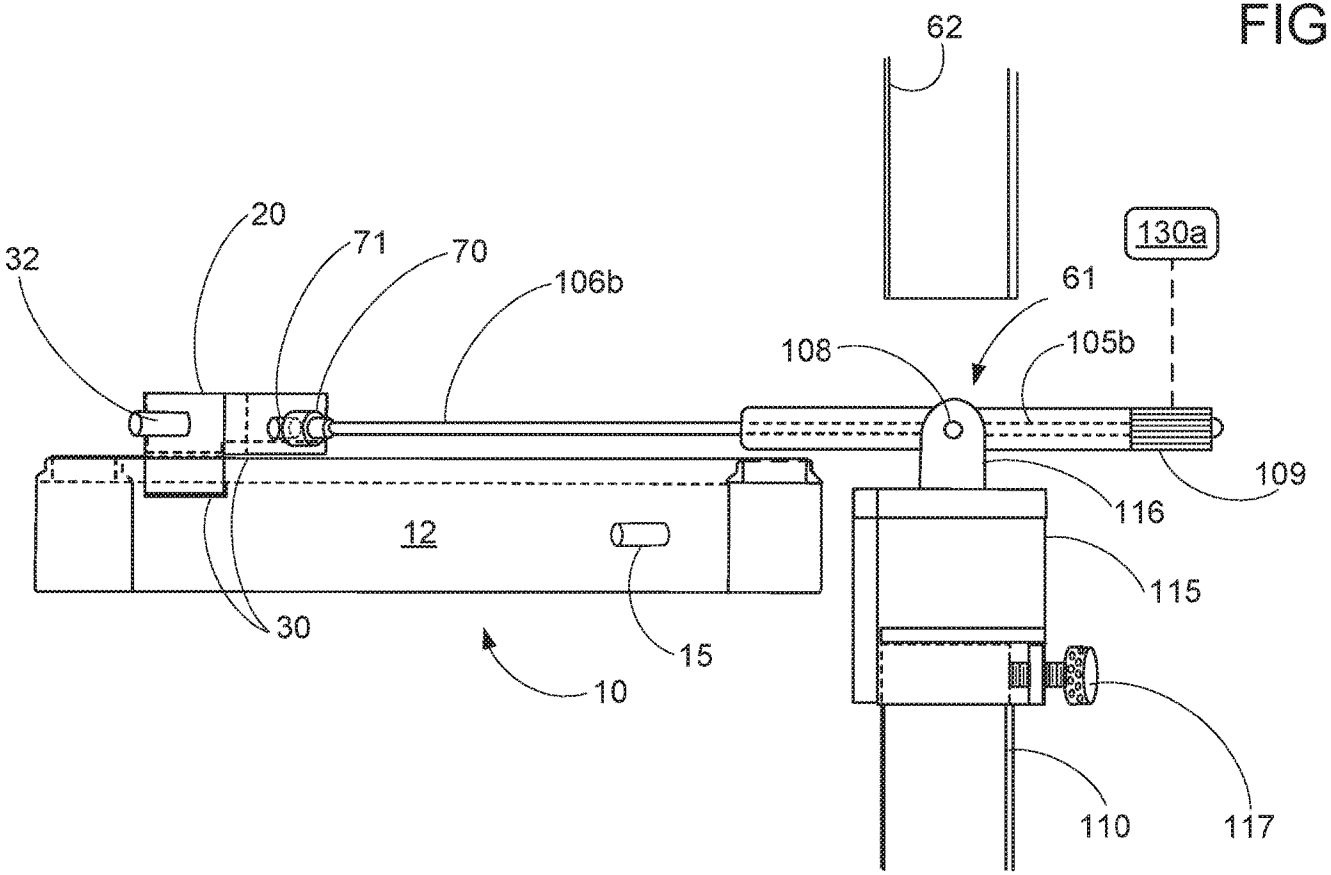
FIG. 6 is a schematic diagram of an air nozzle and cleaning tool shown traversing the air nozzle and including a screw actuator in accordance with certain embodiments.

In certain embodiments, for example see FIGS. 5 and 6, the controllers 130, 130*a* may have a processing unit and a storage element. The processing unit may be a general purpose computing device such as a microprocessor. Alternatively, it may be a specialized processing device, such as a programmable logic controller (PLC). The storage element may utilize any memory technology, such as RAM, DRAM, ROM, Flash ROM, EEROM, NVRAM, magnetic media, or any other medium suitable to hold computer readable data and instructions. The instructions may be those necessary to operate the actuator. The controller may also include an input device, such as a touchscreen, keyboard, or other suitable device that allows the operator to input a set of parameters to be used by the controller. This input device may also be referred to as a human machine interface or HMI. The controller may have outputs adapted to control the actuator. These outputs may be analog or digital in nature, and may provide a binary output (i.e. either on or off), or may provide a range of possible outputs, such as an analog signal or a multi-bit digital output.

In the embodiment of FIG. 5, a source of compressed air 140 is piped through vented solenoid operated valves 131*a* and 131*b* to air connection ports 107*a* and 107*b*. Controller 130 operates solenoid actuators 131 which position the valves 131*a* and 131*b* to supply air pressure effecting the desired extension and retraction movement of linear actuator rod 106 in order to move housing 20. Linear actuator 105 with trunnion mount 108 on the actuator housing is mounted in yoke 116 which is attached to portable mounting bracket 115. The stroke length of rod 106 is preferably selected to provide a travel length suitable to propel housing 20 over the full length of air nozzle body 12. Portable mounting bracket 115 is preferably clamped to the dryer (oven) enclosure frame 110 with clamping hand screw 117 or other suitable means mechanically connecting linear actuator 105 to the dryer (oven) enclosure frame 110 in order to anchor the actuator housing and propel cleaner housing 20 along the length of air nozzle body 12 without need of manual force by a human operator. In certain embodiments, portable bracket 115 may be easily moved along the length of the dryer enclosure frame 110 by loosening hand screw 117 and sliding bracket 115 to a new position in alignment with the next air nozzle body 12 to be cleaned and then retightening hand screw 117.

Turning to FIG. 6, in an alternative embodiment a reversible linear screw actuator 105*b* of the electric type (as available from Electric Automations, Richmond, British Columbia Calif.) may be used to propel housing 20. Motor 109 drives an acme screw, ball screw or other suitable mechanical actuating rod 106*b* of suitable length to extend and retract over the desired length of air nozzle body 12, the actuating rod 106*b* being in mechanical connection with attachment rod 71 and/or flexible coupling 70. Directional power is applied to the drive motor by means of a suitable reversing motor control 130*a* in order to control extension and retraction of electric actuator rod 106*b* as is known to those skilled in the art.

In a preferred embodiment to effectively clean air nozzle 10, control of the linear actuation imparts an oscillatory motion to housing 20 as in a vibratory "scrubbing" action by alternate positioning of the solenoid operated valves piped to the pneumatic cylinder by controller 130 of FIG. 5, or by switching of applied power to the reversible electric linear actuator 105*b* by controller 130*a* of FIG. 6. The switching frequency to effect the oscillatory motion is adjustable by the operator, preferably in the range of 0.5 to 10 Hz with stroke amplitudes in the range of 1 to 20 millimeters in order to effect the vibratory scrubbing action. In a preferred control sequence of operation of either of the arrangements shown in FIG. 5 or FIG. 6, the actuating rod 106 or 106*b* of the linear actuator 105 or 105*b*, respectively, begins the cleaning sequence in an extended position in order to position housing 20 over a beginning position on air nozzle 10 to be cleaned, and executes the vibratory motion for a preset desired period of time, typically 1 to 10 seconds. Following the period of time the actuator rod retracts over a travel distance [substantially] equal to the length of air knife 22 of FIG. 1C, typically in the range of 2 to 6 inches. Following this retraction movement, the vibratory action is again initiated for a preset period of time. The sequence is repeated until the overall actuator rod retraction travel has moved housing 20 fully to the end of air nozzle 10 opposite the beginning position.

While various aspects and embodiments have been disclosed herein, other aspects, embodiments, modifications and alterations will be apparent to those skilled in the art upon reading and understanding the preceding detailed description. The various aspects and embodiments disclosed herein are for purposes of illustration and are not intended to be limiting. It is intended that the present disclosure be construed as including all such aspects, embodiments, modifications and alterations insofar as they come within the scope of the appended claims or the equivalents thereof.

What is claimed is:

1. An air nozzle cleaning tool comprising: a housing; at least two air knife elements in said housing; each air knife element having an air knife discharge slot configured to discharge gas when placed in fluid communication with a gas source, and at least one tab extending from said discharge slot; wherein the air knife discharge slot and the at least one tab is adapted to be aligned with a slot in an air nozzle to be cleaned.

2. The air nozzle cleaning tool of claim 1, further comprising a propelling assembly for propelling the tool along the length of the air nozzle being cleaned.

3. The air nozzle cleaning tool of claim 2, wherein the propelling assembly comprises a spring-loaded yoke for supporting said housing.

4. The air nozzle cleaning tool of claim 1, wherein each air knife element comprises a feed port adapted to be placed in fluid communication with a compressed air source.

5. The air nozzle cleaning tool of claim 1, wherein said housing further comprises seal elements to create a seal between the housing and an air nozzle body.

6. The air nozzle cleaning tool of claim 1, further comprising a connection in fluid communication with a vacuum source for removing dust and dislodged solid material.

7. A system for cleaning an air nozzle, comprising: an air nozzle to be cleaned, said air nozzle having an air nozzle slot; a housing sealed to said air nozzle; a first and second air knife element in said housing, said first and second air knife element having an air knife discharge slot configured to discharge gas when placed in fluid communication with a gas source, and at least one tab extending from said air knife discharge slot, wherein said air knife discharge slot and the at least one tab is aligned with said air nozzle slot such that said at least one tab is received in said air nozzle slot; and a source of compressed air in fluid communication with said first and second air knife element.

8. The system of claim 7, further comprising a propelling assembly for propelling said first and second air knife element along the length of said air bar being cleaned.

9. The system of claim 8, wherein said propelling assembly comprises a spring-loaded yoke for supporting said housing.

10. The system of claim 8, wherein said propelling assembly comprises a controller and a linear actuator responsive thereto.

11. The system of claim 7, wherein said air nozzle to be cleaned has two air bar slots.

12. The system of claim 7, wherein said first and second air knife element comprises a feed port in fluid communication with said compressed air source.

13. The system of claim 7, further comprising a connection in fluid communication with a vacuum source for removing dust and dislodged solid material.

14. An air nozzle and cleaning tool assembly, comprising: an air nozzle having an air nozzle body and first and second spaced air nozzle slots; a housing sealed to said air nozzle body; first and second air knife elements in said housing, each of said first and second air knife elements having an air knife discharge slot configured to discharge gas when placed in fluid communication with a gas source, and at least one tab extending from said air knife discharge slot, wherein said air knife discharge slot and said and at least one tab from each of said first and second air knife elements are aligned with respective air nozzle slots of said air nozzle such that said at least one tab from each of said first and second air knife elements is received in a respective air nozzle slot and gas discharged from said air knife discharge slot of said first and second elements enters a respective air nozzle slot; and a source of compressed air in fluid communication with each of said air knife elements.

* * * * *